United States Patent [19]

Sellers et al.

[11] Patent Number: 4,508,520

[45] Date of Patent: Apr. 2, 1985

[54] HEART-SHAPED LIGHT-EMITTING NOVELTY

[76] Inventors: Richard K. Sellers; Elisabeth A. Sellers, both of 100 Robie St., Buffalo, N.Y. 14214

[21] Appl. No.: 309,690

[22] Filed: Oct. 7, 1981

[51] Int. Cl.[3] ..... A63H 33/26

[52] U.S. Cl. ..... 446/485; 362/104

[58] Field of Search ..... 46/228, 226; 362/200, 362/104

[56] References Cited

U.S. PATENT DOCUMENTS

| | | | |
|---|---|---|---|
| 2,374,375 | 4/1945 | O'Donnell | 362/104 X |
| 2,942,379 | 6/1960 | Oman et al. | 46/228 |
| 3,119,563 | 1/1964 | Ruffman | 46/228 X |
| 3,805,047 | 4/1974 | Dockstader | 362/104 |

*Primary Examiner*—Mickey Yu

[57] ABSTRACT

A light-emitting novelty device having a heart-shaped convex-concave, light transmitting cover; a flat rear cover; and an electrical circuit including a lamp, a battery, and a momentary switch for turning on the lamp as long as the switch is continuously manually activated and turning off the lamp as the activation is discontinued.

1 Claim, 3 Drawing Figures

HEART-SHAPED LIGHT-EMITTING NOVELTY

Be it known that I, Richard K. Sellers, and my spouse Elisabeth A. Sellers, both citizens of the United States, residing together at Buffalo, in the County of Erie, and State of New York, have invented a new and useful "love tester," of which the following is a specification.

Its primary object is to provide amusement when a person touches and presses a plastic momentary switch lightly against an object, or any variation thereof, to cause a plastic heart to illuminate. The illuminating plastic heart, by definition and direction of its inventors, is reasoned to symbolically represent a signal to its user meaning that love exists. When the momentary switch is released, the electrical circuit opens, and the illumination stops.

In the accompanying drawing forming part of this specification

Figure 1:
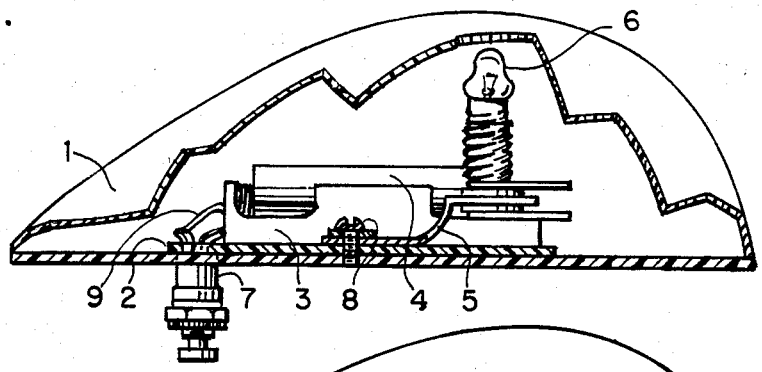
FIG. 1 is an elevation section view taken from FIG. 2 line 1—1.
Figure 2:
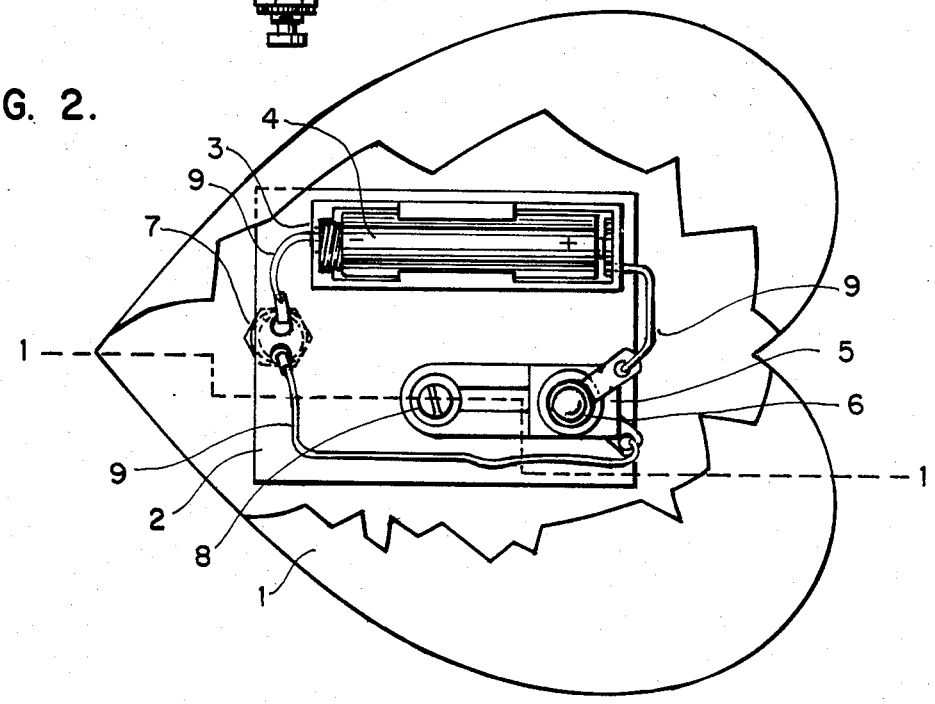
FIG. 2 is a plan view of our invention.
Figure 3:
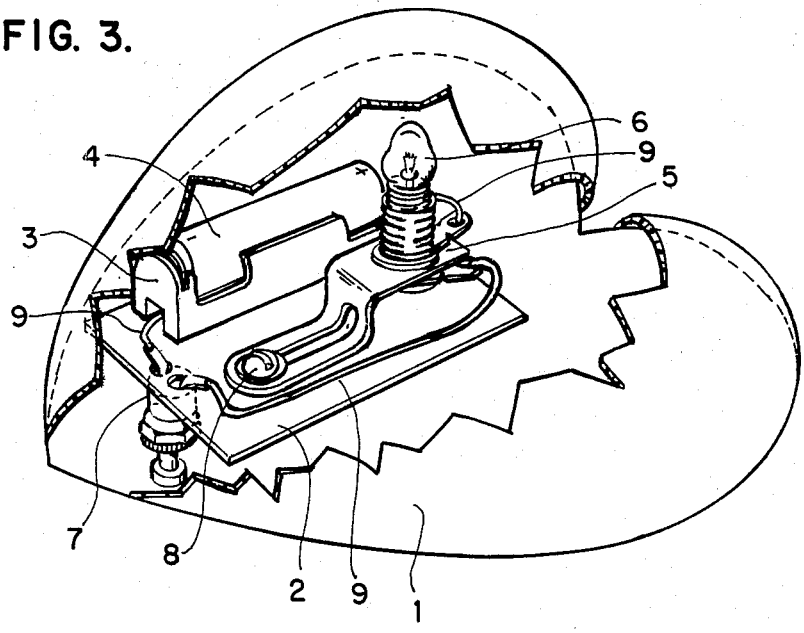
FIG. 3 is a perspective view.

In the drawing, FIGS. 1, 2, and 3, 1 indicates our invention's heart shaped shell, made from plastic, or some other suitable material. Anchored inside the plastic heart on its bottom is a module, comprising of 2, the circuit board. Cemented or attached to the circuit board is 3, a single cell AA size plastic battery holder which stores 4, a AA size battery, 1.5 volts. Number 5, is a metal light holder socket which is attached to the circuit board by 8, a metal screw. Number 6, is a miniature light bulb which is screwed into the socket of the light holder. Number 7, is a plastic momentary switch, single pole, single throw, which is also connected to the circuit board so that its metal conductor terminals protrude through the circuit board into the top side. Number 9, is a thin gauge insulated conductor wire. This wire is responsible for conducting the battery's positive and negative charge into the miniature light bulb. The electrical parts of this module are in a series circuit. When the momentary switch, 7, is pushed the electrical circuit closes, and the battery, 4, releases negative and positive voltage charges through the battery holder, 3. This released electrical energy travels as current along the insulated wire conductor, 9, wherein the negative part of the voltage charge moves into the closed momentary switch, 7, and continues into the light holder socket, 5. The positive part of the battery's electrical voltage charge moves directly as current into the light holder socket, 5, from the battery holder, 3. In the light holder socket, 5, the positive and negative voltage charges centralize into the filament of the miniature light bulb, 6, which cause illumination and light. When the momentary switch is released, the electrical circuit opens, and the illumination stops. We have reasoned through the creation of this toy that the illuminating plastic heart symbolically represent a meaningful signal to amuse the user. The physical action that causes the "love tester" to illuminate is to be interpreted, by definition, and direction, as a positive signal meaning that love exists. We do not intend our invention to be used as a fortune telling device. Its object is entirely for amusement, a toy plastic heart providing light for illumination and a signal to the user that love exists.

Having detailed the description of our invention, the "love tester," we claim as new and desire to protect by Letters Patent the following:

1. A heart-shaped light-emitting novelty device comprising:

(a) a heart-shaped hollow housing having a front convex-concave light transmitting cover and a flat rear cover;

(b) an electric circuit housed in said hollow housing and mounted on said rear cover, said electric circuit comprising wire means connecting an electric lamp, a battery, and a switch in a series circuit; said switch being a momentary switch and is mounted on said rear cover through an opening thereon, whereby a portion of said switch is located outside of said housing to allow manual activation of said switch to close said electric circuit to thereby turn-on said electric lamp as long as said switch is manually activated and to turn-off said electric lamp as said manual activation is discontinued.

* * * * *